US009347627B2

(12) United States Patent
Sharrah

(10) Patent No.: US 9,347,627 B2
(45) Date of Patent: May 24, 2016

(54) BATTERY POWERED LIGHT WITH ALIGNMENT MECHANISM

(71) Applicant: Streamlight, Inc., Eagleville, PA (US)

(72) Inventor: Raymond L. Sharrah, Collegeville, PA (US)

(73) Assignee: STREAMLIGHT, INC., Eagleville, PA (US)

( * ) Notice: Subject to any disclaimer, the term of this patent is extended or adjusted under 35 U.S.C. 154(b) by 0 days.

(21) Appl. No.: 14/956,354

(22) Filed: Dec. 1, 2015

(65) Prior Publication Data

US 2016/0076714 A1 Mar. 17, 2016

Related U.S. Application Data

(63) Continuation of application No. 14/090,628, filed on Nov. 26, 2013, now Pat. No. 9,217,547.

(60) Provisional application No. 61/730,050, filed on Nov. 26, 2012, provisional application No. 61/751,690, filed on Jan. 11, 2013.

(51) Int. Cl.

| | |
|---|---|
| ***F21L 4/00*** | (2006.01) |
| ***F21V 23/02*** | (2006.01) |
| ***F21V 31/00*** | (2006.01) |
| ***F21V 15/01*** | (2006.01) |
| *F21Y 101/02* | (2006.01) |

(52) U.S. Cl.

CPC . *F21L 4/00* (2013.01); *F21V 15/01* (2013.01); *F21V 23/02* (2013.01); *F21V 31/005* (2013.01); *F21Y 2101/02* (2013.01)

(58) Field of Classification Search

CPC ..... F21L 4/005; F21L 19/00; F21L 4/00; F21L 11/00; F21L 7/00; F21L 15/00; F21V 15/00; F21V 15/01; F21V 31/00; F21V 31/005; F21V 23/0407; F21V 23/0414; F21V 23/02

See application file for complete search history.

(56) References Cited

U.S. PATENT DOCUMENTS

| | | | |
|---|---|---|---|
| 6,030,094 | A | 2/2000 | Sedovic |
| D424,227 | S | 5/2000 | Long |
| 6,394,630 | B1 | 5/2002 | Skidmore |
| 6,550,932 | B2 | 4/2003 | Poon |

(Continued)

OTHER PUBLICATIONS

Ultimate Survival Gear, Product Descr. http://www.reveresupply.com/2013_ust_site/Root/2_30-day_lantern.html prior to Nov. 26, 2012.

(Continued)

*Primary Examiner* — Bao Q Truong

(74) *Attorney, Agent, or Firm* — Stephen H. Eland; Dann, Dorfman, Herrell & Skillman

(57) ABSTRACT

A portable lamp is provided that is powered by a plurality of batteries. The lamp includes a housing having a battery compartment with a removable closure. The closure includes a plurality of electrically conductive contacts configured to contact batteries in the battery compartment. The battery compartment and the closure comprise mating alignment elements adapted to align the contacts on the closure with batteries in the battery compartment. The alignment element on the closure is configured to move relative to the closure when the closure is twisted relative to the battery compartment to connect the closure to the housing. The lamp also incorporates a valve that may be integrally formed with a sleeve on the housing.

28 Claims, 8 Drawing Sheets

(56) References Cited

U.S. PATENT DOCUMENTS

| | | | | |
|---|---|---|---|---|
| D483,892 | S | 12/2003 | Poon | |
| 6,685,337 | B2 | 2/2004 | Klees | |
| 6,789,918 | B2 | 9/2004 | Poon | |
| D537,968 | S | 3/2007 | Shiu | |
| D542,953 | S | 5/2007 | Lee | |
| D547,891 | S | 7/2007 | Shiu | |
| D559,418 | S | 1/2008 | Poon | |
| D575,429 | S | 8/2008 | Shiu | |
| D599,923 | S | 9/2009 | Shiu | |
| D608,920 | S | 1/2010 | Loibl | |
| D611,630 | S | 3/2010 | Chan | |
| D650,104 | S | 12/2011 | Brands et al. | |
| D658,324 | S | 4/2012 | Reimann et al. | |
| 9,217,547 | B2 * | 12/2015 | Sharrah | F21L 4/005 |

OTHER PUBLICATIONS

Lighting Ever, Product Descr, http://www.lightingever.com/led-lanter-light-300lm.html prior to Nov. 26, 2012.

Rayovac Product Descr http://www.rayovac.com/Products/Lights/Outdoor/LED-4-Watt-3D-240-Lumen-Area-Lantern.aspx prior to Nov. 26, 2012.

Imperial, Product Descr http://www.amazon.com/Portable-Purpose-Bright-Camping-Lantern/dp/B00896N8CO/ref=pd_rhf_se_p_t_2_M600 prior to Nov. 26, 2012.

Nichia, Product Descr. http://www.amazon.com/Nichia-300-Lumens-Extreme-Lantern/dp/B008DXYTYE/ref=pd_rhf_dp_p_t_4_Z09X prior to Nov. 26, 2012.

Eureka!, Product Descr. http://www.amazon .com/Eureka-Magic-125-Lantern-Flashlight/dp/B002NM39VA/ref=sr_1_31?s=sporting-goods&ie=UTF8&qid=1397057806&sr=1-31, prior to Nov. 26, 2012.

Coleman, Product Descr. http://www.coleman.com/product/pack-away-led-lantern/4345-702?contextCategory=10454 prior to Nov. 26, 2012.

Coleman, Product Descr. http://www.coleman.com/product/4d-cpx-personal-size-led-lantern/2000008545?contextCategory=10452 prior to Nov. 26, 2012.

Coleman, Product Descr., http://www.amazon.com/Coleman-4D-Pack-Away-LED-Lantern/dp/B00168OD62 prior to Nov. 26, 2012.

Coleman, Product Descr. http://www.amazon.com/Coleman-CPX6-High-Tech-LED-Lantern/dp/B00CHHNLZ0/ref=pd_sbs_sg_1?ie=UTF8&refRID=1YFB7SJSRPNWB24F2NCB prior to Nov. 26, 2012.

* cited by examiner

BATTERY POWERED LIGHT WITH ALIGNMENT MECHANISM

PRIORITY CLAIM

This application is a continuation of co-pending U.S. patent application Ser. No. 14/090,628 filed Nov. 26, 2015. This application claims priority to U.S. Provisional Application No. 61/730,050 filed Nov. 26, 2012 and U.S. Provisional Application No. 61/751,690 filed Jan. 11, 2013. The entire disclosure of each of the foregoing applications is hereby incorporated herein by reference.

FIELD OF INVENTION

The present invention relates to the field of battery powered lights. In particular the present invention relates to lights having a plurality of battery elements that are not axially aligned.

BACKGROUND

A variety of battery powered lights have been produced far numerous applications. A common portable light is a flashlight that is powered by a number of battery cells. Typically, the battery cells are axially aligned inside a cylindrical housing to form a stack of serially connected cells. In other lights, a number of batteries are inserted into a battery holder that is then inserted into the housing of the light. In either configuration, the batteries and the contacts self-align when the batteries are inserted into the light. However, in certain light configurations, it is not desirable to stack the battery cells. In such configurations the alignment between the contacts of the cells and the contacts on the housing can be an issue particularly if the user is attempting to change the batteries in a low-light environment, which a common occurrence when using a portable light. If the batteries are not properly aligned with the contacts, the portable light will not work.

SUMMARY OF THE INVENTION

In light of the foregoing, there exists a need for a portable light having an alignment mechanism to ensure contact between a plurality of batteries and the contacts connected with the light element. In particular, there exists the need for such an alignment element for battery powered lights that use a plurality of battery cells that are not axially aligned.

According to one aspect, a battery powered light is provided which includes a light element for providing a source of light and a housing for housing the light. The housing comprises a battery compartment comprising a plurality of chambers wherein each chamber is configured to receive a battery. A cover for closing an opening to the battery compartment and the cover comprises a releasable connection with the housing so that twisting the cover relative to the housing connects or disconnects the cover with housing. A plurality of contacts connected with the cover are configured to electrically engage the batteries when the batteries are in the battery compartment. The light also includes first and second alignment elements configured to matingly cooperate to guide the contacts into electrical contact with batteries when batteries are in the battery compartment. Additionally, the plurality of contacts are rotatable relative to the cover when the cover is rotated to connect or disconnect the cover with the housing.

According to another aspect, the present invention also provides a battery powered light having a light element connected with a housing and a sleeve covering a portion of the housing. The sleeve is formed of a resiliently deformable material and a valve is integrally formed with the sleeve. The valve forms a fluid-tight seal to impede migration of fluid into the housing. The valve may also allow pressurized fluid to vent from the housing.

DESCRIPTION OF THE DRAWINGS

The foregoing summary and the following detailed description of the preferred embodiments of the present invention will be best understood when read in conjunction with the appended drawings, in which.

DETAILED DESCRIPTION OF THE INVENTION

Referring now to the figures in general, a portable battery-powered light is designated generally 10. In the present instance, the light 10 is a lantern configured to illuminate a broad area. However, the light may be configured as a more coherent light, such as a flashlight or other lamp having a focused beam. Accordingly, it should be understood that although the light is described in the following description as a lantern, it should be understood that the light is not limited to the configuration of a lantern.

Figure 1:
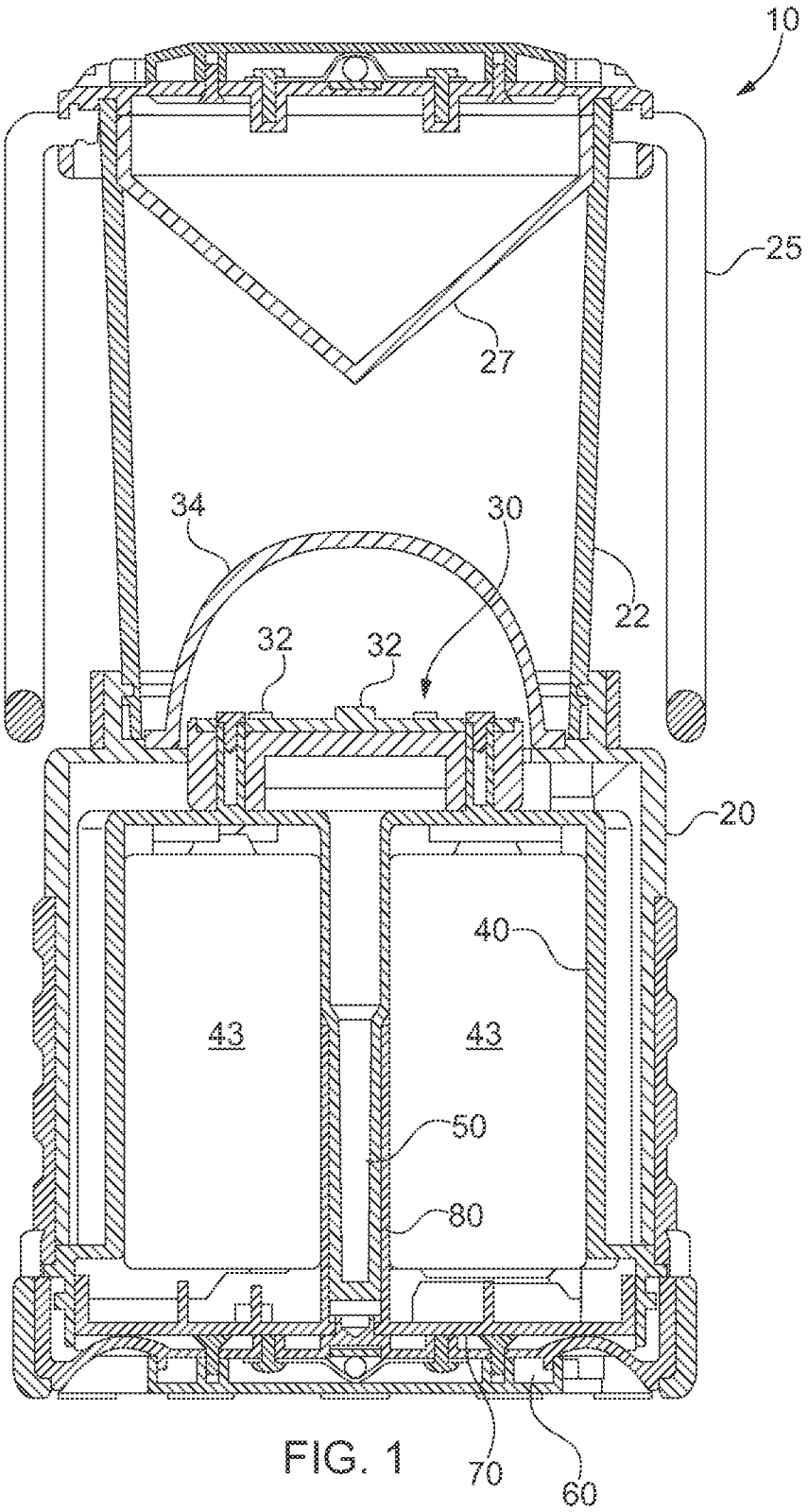
FIG. 1 is a cross-sectional view of a battery powered light.

Referring to FIG. 1, the lantern 10 includes a housing 20 that includes a battery compartment 40. The bottom of the battery compartment is enclosed by a removable cover 60. A light element 30 disposed at the top of the housing 20 provides a diffuse light source. However, in certain applications it may be desirable to use a focused light element.

The light element 30 may be any of a variety of elements for providing a light source, including, but not limited to incandescent, halogen, xenon or fluorescent bulbs. However, in the present instance, the light element 30 comprises one or more light emitting diodes. Specifically, the light element comprises a plurality of LEDs spaced apart from one another to provide a diffuse light source. Additionally, a dome 34 overlying the light elements diffuses the light from the LEDs.

As shown in FIG. 1 an elongated generally cylindrical globe 22 surrounds the light element. The globe 22 may be formed from plastic or glass so that the globe is transparent or translucent. In the present instance, the globe 22 is formed of substantially transparent plastic. A generally conical reflector 27 is disposed at the top end of the globe 22 opposing the light element. The reflector reflects the light from the light element 30 outwardly to illuminate a broad area. A cap attached to the top end of the globe encloses the top end of the globe. A handle 25 may be pivotably attached to the cap for holding the lantern 10.

Referring to FIGS. 1-8, the details of the battery compartment will be described in greater detail. The battery compartment 40 may be formed into the housing 20 or the battery compartment may be a separate element connected with the housing. In the present instance, the battery compartment 40 is formed separately and rigidly connected with the housing by a mechanical connection, such as by fasteners. Alternatively, the battery compartment may be welded or bonded to the housing by epoxy or other adhesive.

Figure 2:
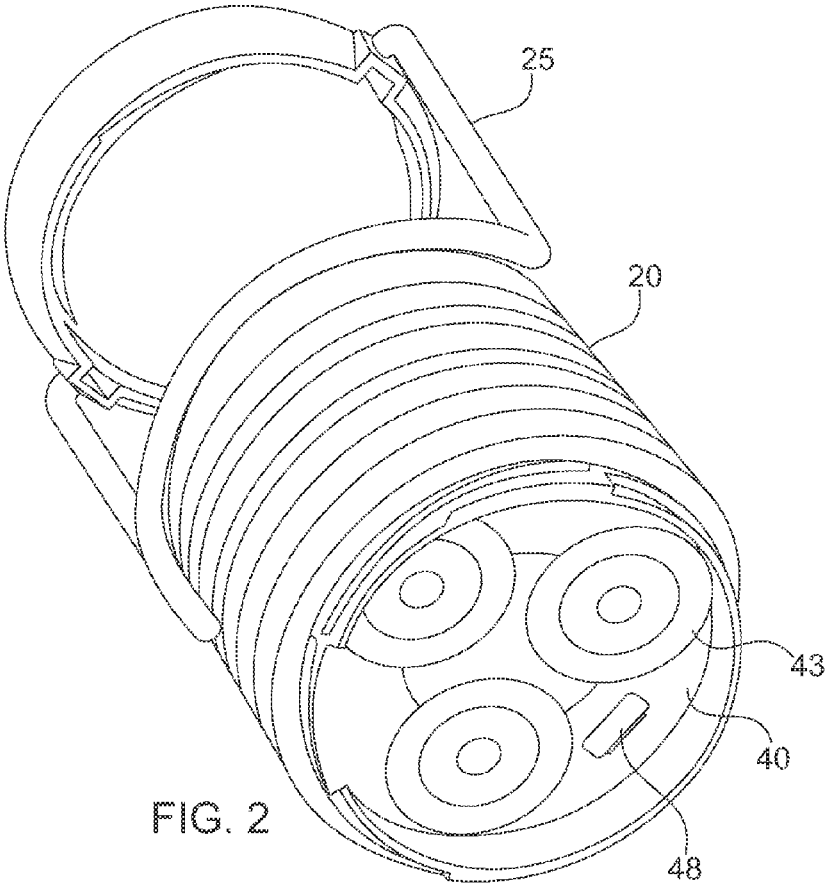
FIG. 2 is a fragmentary perspective view of the light illustrated in FIG. 1.

Referring to FIGS. 2 and 4-7, the battery compartment 40 comprises a plurality of battery chambers 42 configured to receive a battery 43. In the present instance, the battery chambers are generally cylindrical sockets configured to receive a battery in a vertical orientation. For example, as shown in FIG. 2, the battery compartment 40 is configured to house three "D" cell batteries in a vertical orientation so that the anode or cathode of each battery is exposed at the bottom of the battery compartment.

The battery chambers 42 are spaced apart around a battery compartment 40 so that the batteries are not coaxial. In other words, the longitudinal axes of the batteries are generally parallel but are spaced apart from one another when the batteries are loaded in the battery compartment. In this way, the anode of each battery is spaced apart from the cathode of each of the other batteries.

To connect the batteries 43 in series with one another and with the light element 30, the lantern includes a plurality of conductive elements, such as metallic contacts. For example, in the present instance, the lantern 10 includes a first contact 44 positioned in the top of a first battery chamber 42. The first contact 44 is configured to electrically contact the cathode of a battery in the first chamber and is electrically connected with a circuit board on which the LEDs of the light element 30 are mounted. A second contact 46 is positioned in the top of the battery compartment and extends between the second and third battery chambers 42. The second contact 46 is configured to contact the anode of the second battery 43 and the cathode of the third battery so that the second and third batteries are serially connected. A third contact 48 is an elongated conductor in electrical connection with the circuit board. The third contact 48 extends the length of the battery compartment and has an exposed contact surface at the bottom of the battery compartment 40 as shown in FIG. 2.

Figure 6:
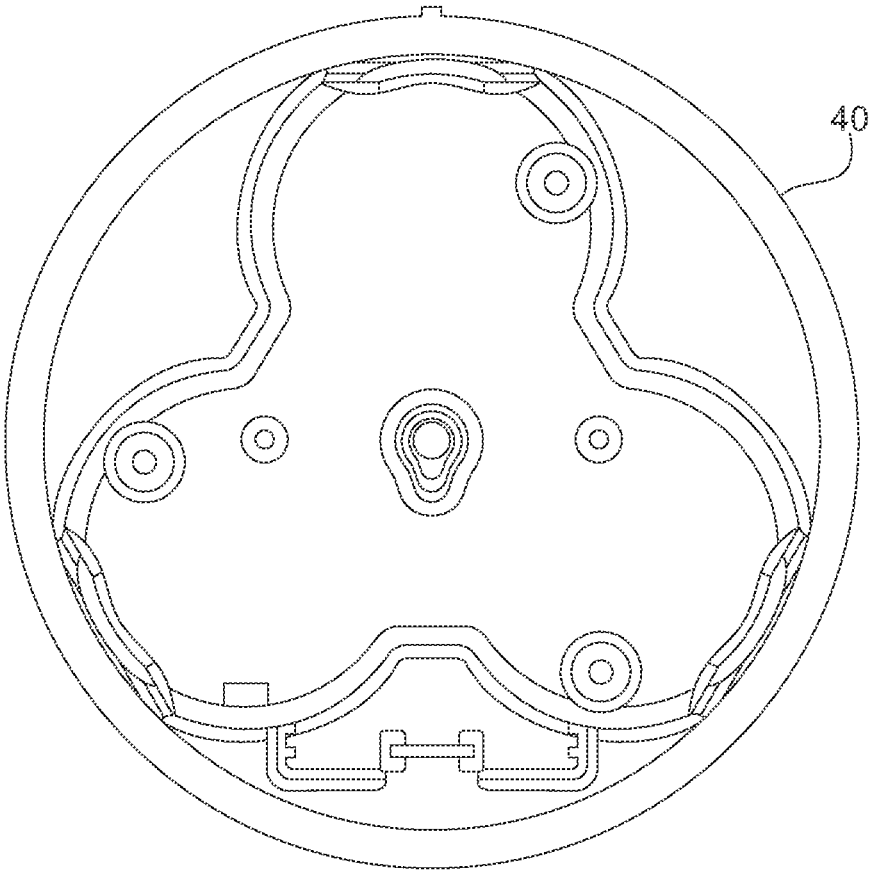
FIG. 6 is a plan view of the battery compartment illustrated in FIG. 4.
Figure 7:
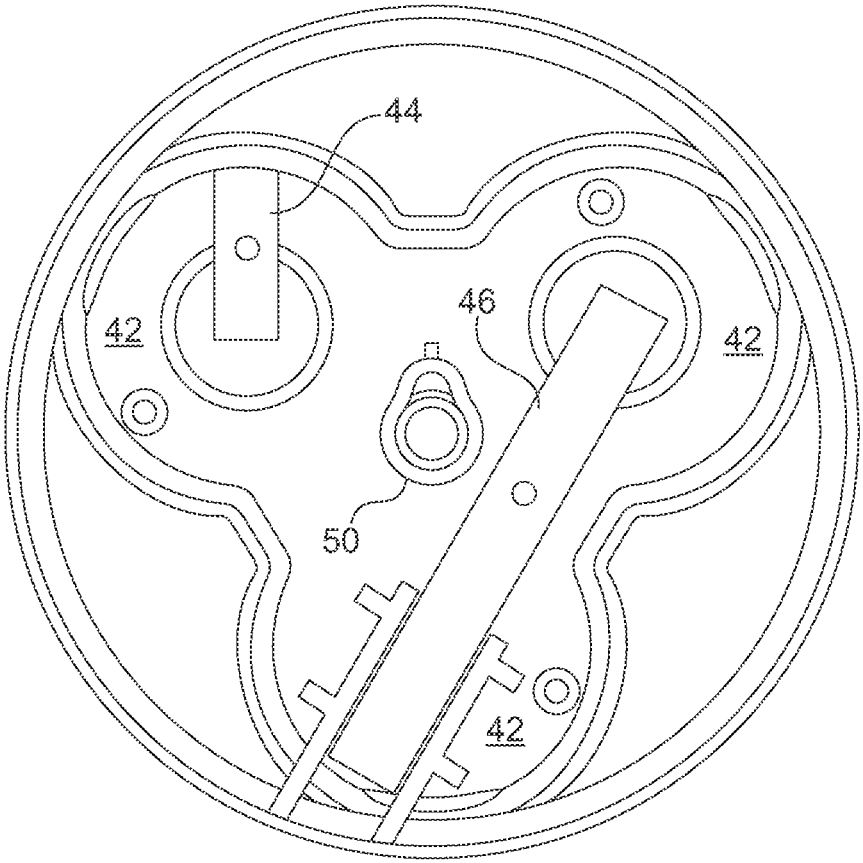
FIG. 7 is a bottom view of the battery compartment illustrated in FIG. 4.

The battery compartment 40 may also include a plurality of alignment pins or studs for aligning the battery compartment relative to the circuit board on which the LEDs are mounted as shown in FIGS. 1 and 6. Additionally, the battery compartment may include a plurality of holes through the top wall of the battery compartment for fastening the battery compartment to the bosses or tabs formed in the interior of the housing, as shown in FIG. 1.

Figure 3:
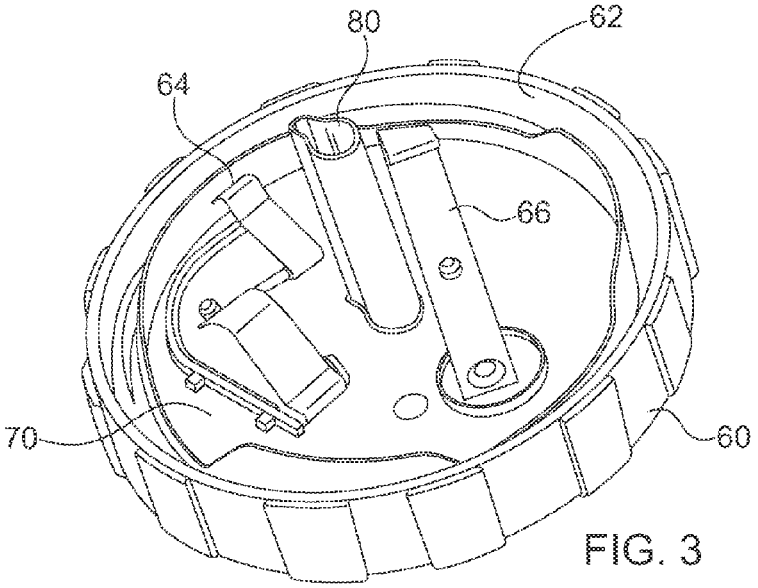
FIG. 3 is a perspective view of a cap of the battery compartment of the light illustrated in FIG. 1.
Figure 4:
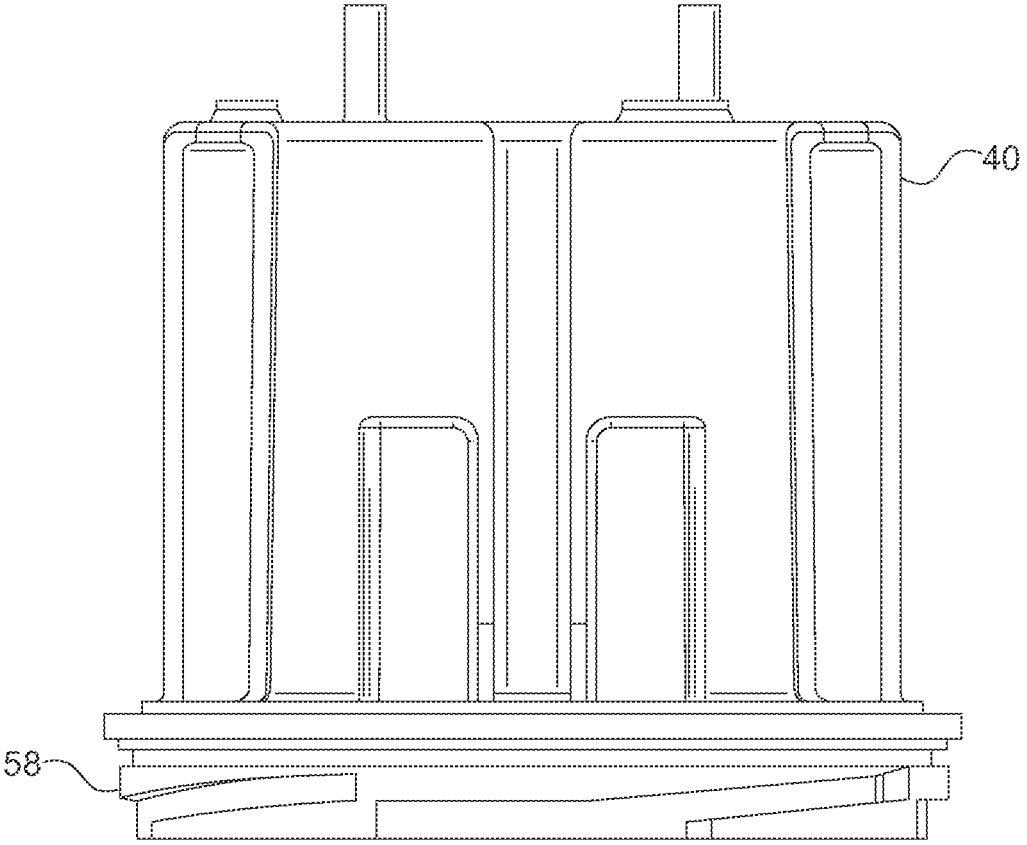
FIG. 4 is a side view of the battery compartment of the light in FIG. 1.
Figure 5:
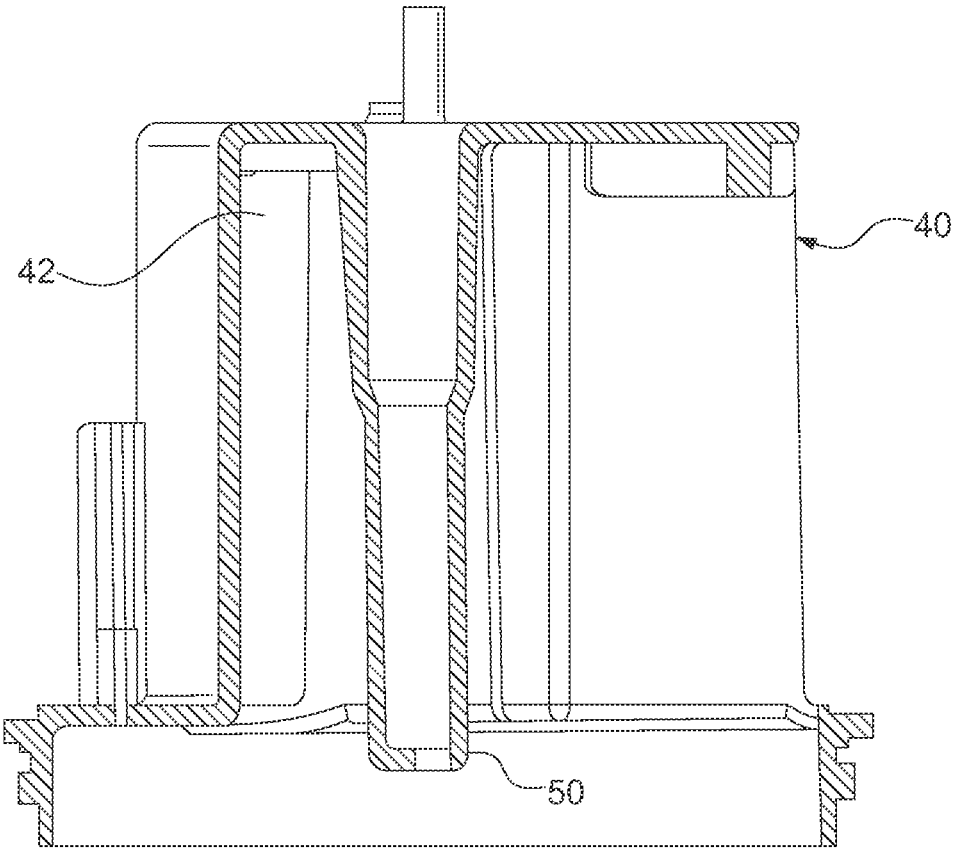
FIG. 5 is a sectional view of the battery compartment illustrated in FIG. 4.

The bottom end of the battery compartment 40 is generally open. Accordingly, the lantern 10 includes a cover 60 for covering the open end of the battery compartment. In particular, the cover 60 is releasably connectable with the battery compartment or the housing to form a fluid-tight seal to impede fluid from entering the battery compartment. In the present instance, the cover 60 comprises female threads 62 that threadedly engage male threads 58 formed on the bottom end of the battery compartment 40 as shown in FIGS. 2-4.

A plurality of electrical conductive elements 64, 66, such as metal contacts, are connected with the cover 60. The contacts 64, 66 may be directly connected with the cover, however, in the present instance the contacts 64, 66 are mounted on a separate element, such as contact plate 70 shown in FIGS. 8-9. The fourth contact 64 is an elongated contact having a first end configured to engage the exposed surface of the third contact 48 shown in FIG. 2 and a second end configured to contact the anode of one of the batteries. The fifth contact 66 is an elongated contact having a first end configured to contact an anode of the second battery and a cathode of the third battery.

The contact plate 70 may be connected with the cover 60 in a variety of ways. However, in the present instance, the contact plate is rotatably connected with the cover 60 so that the contact plate 70 can pivot or rotate relative to the cover. In this way, the contact plate is connected with the cover so that displacing the cover axially also displaces the contact plate 70, but the contact plate 70 may rotate relative to the cover when the cover is rotated or twisted.

A second alignment element 80 is formed adjacent the fourth and fifth contact 64, 66 and is configured to cooperate with the first alignment element 50 on the battery compartment. The first and second alignment elements cooperate to guide the fourth and fifth contacts into electrical connection with the batteries 43 and the third contact 48.

Figure 8:
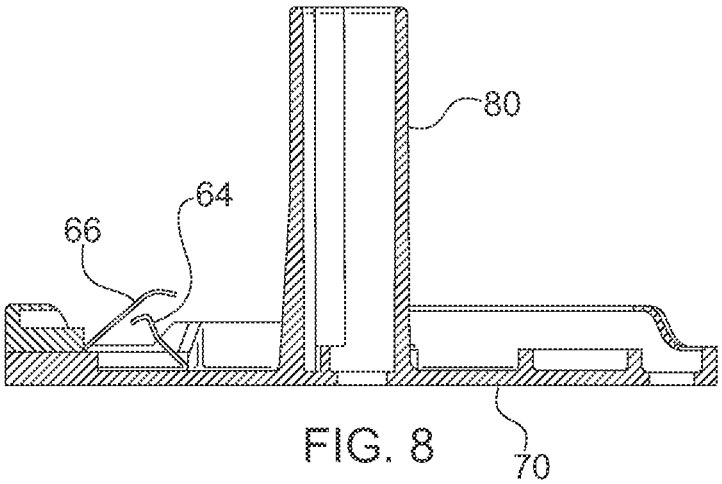
FIG. 8 is a sectional view of a contact plate of the light illustrated in FIG. 1.
Figure 9:
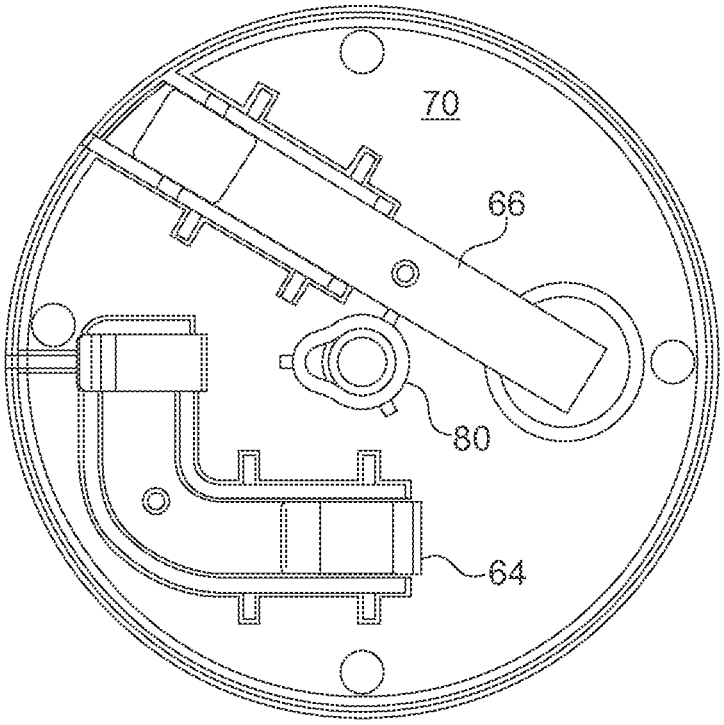
FIG. 9 is a plan view of the contact plate illustrated in FIG. 8.

The alignment elements 50, 80 may be configured in a variety of configurations to guide the contacts into contact with the batteries 43 and the third contact 48. In the present instance, the alignment elements comprise an elongated post and an elongated socket configured to receive the elongated post. As shown in FIGS. 1-2, 5 and 7, the elongated post 50 is formed in the battery chamber 40 so that the upper end of the post is attached with the top of the battery compartment and the post extends substantially the entire length of the battery compartment. As shown in FIGS. 1, 3 and 8, the elongated socket 80 projects upwardly from the contact plate 70. The socket 80 is hollow and has an interior configured to mate with the exterior configuration of the guide post 50.

The guide post 50 may be configured to have any of a variety of cross-sectional shapes. Preferably the cross-sectional shape is non-circular to impede rotation of guide post relative to the alignment socket 80 when the guide post 50 is nested within the socket. Additionally, preferably the cross-section shape is asymmetric in one direction so that the guide post and the alignment socket define a particular alignment of the battery compartment 40 relative to the contacts 64, 66 when the guide post is inserted into the alignment socket. For instance, in the present instance the exterior surface of the guide post 80 has a teardrop-shaped cross section and the alignment socket has an interior surface with a matingly-shaped teardrop configuration as shown in FIGS. 1, 2-3, 7 and 9. In this way, the guide post can only be inserted into the alignment socket when the narrow tip teardrop-shape of the guide post is aligned with the narrow tip of the teardrop shape of the alignment socket. In other words, the alignment elements 50, 80 define a single relative angular relationship between the contact plate 70 and the battery compartment 40. In this way, the mating alignment elements ensure that the contacts connected with the cover 60 make the necessary electrical connections when the cover is connected to the housing.

By mounting contact 64 and 66 on the contact plate 70, the two contacts are displaceable relative to the cover 60 after the contacts are aligned with the respective electrical elements of the battery compartment. In this way, when the guide post 50 is inserted into the alignment socket 80, the contacts 64, 66 are aligned with contacts of the batteries 43 in the battery compartment 40 and with the exposed surface of the elongated contact 48. When the cover is subsequently rotated to connect the cover to the housing 20, the rotatable connection between the contact plate 70 and the cover allows the cover to rotate relative to the contact plate so that the contacts 64, 66 on the contact plate stay in the proper alignment with the batteries 43 and the elongated contact 48. In other words, when the cover 60 is rotated to threadedly engage the threaded portion of the housing, the contacts connected with the cover are not displaced laterally.

Figure 10:
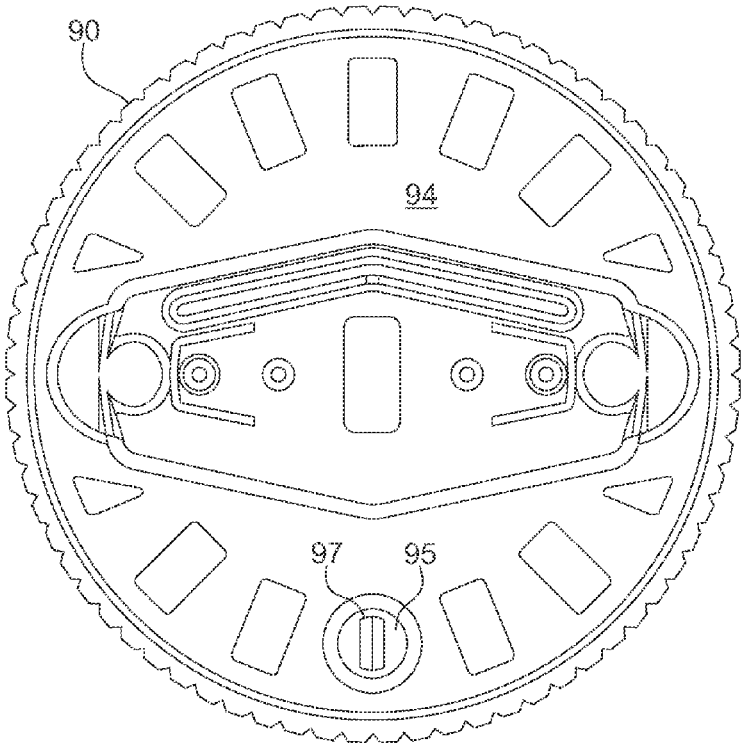
FIG. 10 is a bottom view of the cap illustrated in FIG. 3.
Figure 11:
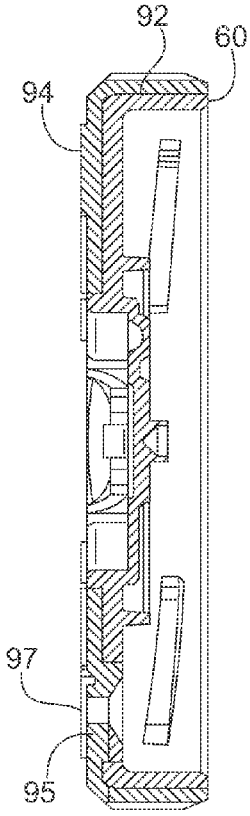
FIG. 11 is a sectional view of the cap illustrated in FIG. 10.

Referring to FIGS. 10-11, in the present instance, the cap 60 includes a sleeve 90 formed of a pliable non-slip material such as a low durometer thermoplastic elastomer, rubber, silicone or other similar material. The sleeve 90 circumscribes the cap 60 to make the cap easier for the user to grip and to make the light less likely to slide when the light is placed onto a table or other surface.

The sleeve 90 comprises an outer ring that extends around the circumference of the cap to form a ring 92 around the edge of the cap. The sleeve also comprises a bottom face 94 that extends over a portion of the bottom of the cap 60 so that the bottom 94 of the sleeve 90 forms the engagement surface that supports the light when the light is placed on a surface. Since the sleeve 90 is formed of a non-slip material, the bottom 94 provides a non-slip surface for the light 10

In the present instance, the sleeve 90 is formed as a separate element and then mounted onto the cap 60. The sleeve may be fixed to the cap by adhesive, however, in the present instance, the sleeve has a plurality of gripping elements formed into the sleeve that engage the cap 60 to retain the sleeve on the cap. Specifically, the sleeve 90 comprises a plurality of feet that resiliently deform by compressing inwardly to pass through one or more apertures in the cap and then expanding to engage the inner face of the cap.

The light 10 also includes a valve for releasing gases that may build-up inside the housing of the light. The valve may be a separate element that is formed and the attached to the housing to allow gases to exit the housing while preventing water and debris from migrating into the housing. However, in the present instance, the valve is integrally formed into the sleeve.

The valve 95 is a duck bill valve formed of resiliently deformable material. The valve 95 is formed into the sleeve so that the valve comprises a thin diaphragm 97. During the molding of the sleeve 90, the diaphragm is formed as a continuous thin portion of the sleeve, thereby forming a thin membrane or diaphragm that has a thinner wall thickness than the ring 92 and substantially the remaining portion of the bottom 94 of the sleeve. After the sleeve 90 is formed, the diaphragm is slit to form the valve. More specifically, the diaphragm is pierced through the entire wall thickness and cut to form a narrow slit. The slit in the diaphragm is the opening of the valve 95.

During operation, the slit in the diaphragm seals against itself to form a fluid-tight seal to impede the migration of water and/or debris, including fine debris such as dust, into the housing. However, if the fluid pressure in the housing increases from gases formed by the batteries, the fluid-pressure in the housing overcomes the seal of the valve 95 to open the slit allowing the gas to vent outside of the housing. In this way, the valve operates as a one-way valve or check valve.

In the foregoing description, the valve 95 is described as being formed into the sleeve surrounding the cap 60. However, it should be understood that the valve could be integrally formed in other parts of the housing. For instance, a gripping ring or sleeve could be formed around the housing. The valve 95 could be formed in the gripping ring or sleeve circumscribing the housing.

The lantern 10 also includes a switch for controlling operation of the light element 30. The switch may be any of a variety of switches, and in the present instance, the switch is a push button switch. The light elements may simply be operable between on and off, however, in the present instance, the light elements include a variety of operational conditions. For instance, the light element may include an electronic controller responsive to the switch to control the light provided by the light element 30. For example, pressing the switch once can signal the controller to control the light element to toggle between on and off. Double-clicking the switch (i.e. pressing the switch twice within a pre-defined time period) can switch the light to a first dimmed condition (e.g. 75% of maximum illumination) and triple-clicking the switch (i.e. pressing the switch three times within a pre-defined time period) can switch the light to a second dimmed condition (e.g. 50% of maximum illumination). Similarly, pressing and holding the switch can change the light output of the lamp. For instance, in the present instance, the light element also comprises a red LED and pressing and holding the switch illuminates the red LED. Additionally, pressing the switch after illuminating the red LED causes the red LED to strobe in an emergency strobe pattern. Accordingly, it should be understood that the light of the light element 30 may be controlled in a variety of patterns and illumination levels.

It will be recognized by those skilled in the art that changes or modifications may be made to the above-described embodiments without departing from the broad inventive concepts of the invention. It should therefore be understood that this invention is not limited to the particular embodiments described herein, but is intended to include all changes and modifications that are within the scope and spirit of the invention as set forth in the claims.

The invention claimed is:

1. A battery powered light, comprising:

a light element for providing a source of light;

a housing connected with the light element, wherein the housing comprises a battery compartment comprising a plurality of battery chambers, each battery chamber being configured to receive a battery in a generally vertical orientation;

a plurality of first contacts adjacent a first end of the battery compartment and aligned with the battery chambers so that the first contacts are positioned to engage battery electrodes when batteries are in the battery compartment;

a cover for closing an opening to the battery compartment at a second end of the battery compartment, wherein the cover comprises a releasable connection with the housing configured such that twisting the cover relative to the housing connects or disconnects the cover with housing;

a contact assembly rotatably connected with the cover so that the contact assembly is rotatable relative to the cover when the cover is rotated to connect or disconnect the cover with the housing, wherein the contact assembly comprises a contact base and a plurality of second contacts mounted on the contact base;

a first alignment element projecting upwardly from the contact base into the housing;

a second alignment element connected with the housing and configured to cooperate with the first alignment element to align the second contacts with the battery chambers so that the second contacts are positioned to electrically engage batteries when the cap is attached to the housing and batteries are in the battery compartments;

wherein one of the first and second alignment elements is an elongated rod and the other of the first and second alignment elements is configured to matingly engage the elongated rod.

2. The light of claim 1 wherein each battery chambers is elongated along an axis and the first alignment element is elongated along an axis parallel to the battery chambers' axes of elongation.

3. The light of claim 1 comprising an elongated contact electrically connected with one of the first contacts and extending the length of the battery chambers so that the elongated contact is in electrical contact with one of the second contacts when the cap is connected to the housing.

4. The light of claim 1 wherein the first alignment element has a length and a width and the length of the alignment element is substantially longer than the width.

5. The light of claim 1 wherein the second alignment element comprises an elongated socket configured to matingly engage the elongated rod.

6. The light of claim 1 wherein the elongated rod has a non-circular cross-section.

7. The light of claim 6 wherein the light is a lantern comprising a reflector for dispersing light from the light element.

8. The light of claim 7 wherein the battery compartment is fixed in position relative to the housing.

9. The light of claim 1 wherein the releasable connection of the cover comprises a threaded portion for threadedly connecting the cover with the housing.

10. The light of claim 9 wherein the first and second alignment elements are configured such that aligning the first alignment element with the second alignment element aligns the second contacts of the contact assembly with contacts of the batteries when batteries are in the battery compartment and the first end second alignment elements are configured to maintain the battery contacts in alignment with the second contacts as the contact assembly is displaced axially toward the battery compartment.

11. The light of claim 6 wherein the first and second alignment elements matingly engage to impede rotation of the contact assembly relative to the housing.

12. The light of claim 11 wherein the first alignment element is axially elongated so that the first alignment element can be inserted into the second alignment element when the cap is spaced from the housing.

13. The light of claim 1 wherein the cap has a height and the first alignment has a height that is greater than the height of the cap.

14. The light of claim 13 comprising a seal for providing a fluid-tight seal between the cover and the housing.

15. A battery powered light, comprising:

a light element for providing a source of light;

a housing for housing the light, wherein the housing comprises a plurality of battery compartments configured to receive a plurality of batteries;

a cover for closing an opening to housing, wherein the cover comprises a releasable connection with the housing configured such that twisting the cover relative to the housing connects or disconnects the cover with housing;

a contact plate comprising a plurality of contacts engageable with a plurality of batteries when batteries are in the battery compartment;

a first alignment element connected with the housing so that the first alignment element is not rotatable relative to the housing;

a second alignment element connected with the cover and configured to matingly cooperate with the first alignment element to guide the contacts into electrical contact with the batteries when batteries are in the battery compartment;

wherein the first alignment element is one of an elongated alignment rod and an elongated alignment socket configured to receive the alignment rod and the second alignment element is the other of the alignment rod and the alignment socket;

wherein the contact plate is rotatable relative to the cover when the cover is rotated to connect or disconnect the cover with the housing.

16. The light of claim 15 wherein the contact plate is rotatably connected with the cover such that the cover rotates relative to the contact plate when the cover is rotated to connect the cover to the housing.

17. The light of claim 16 wherein the alignment rod has a non-circular cross-section.

18. The light of claim 17 wherein the first and second alignment elements matingly engage to impede rotation of the contact plate relative to the housing.

19. The light of any of claim 18 wherein the battery compartment is fixed in position relative to the housing.

20. The light of claim 16 wherein the releasable connection of the cover comprises a threaded portion for threadedly connecting the cover with the housing.

21. The light of claim 20 wherein the battery compartments are located so that when a plurality of generally cylindrical batteries are in the housing the batteries are adjacent one another so that the longitudinal axes of the batteries are offset from one another.

22. The light of claim 21 wherein the battery compartments comprise a plurality of vertically oriented generally cylindrical chambers spaced apart from one another wherein each cylindrical chamber is configured to receive a battery in a general vertical orientation.

23. The light of claim 22 wherein the first alignment element projects upwardly from the contact plate so that the first alignment element projects above a rim of the cover.

24. The light of claim 15 wherein the first alignment element is axially elongated so that the first alignment element can be inserted into the second alignment element when the cap is spaced from the housing.

25. The light of claim 15 wherein the cap has a height and the first alignment has a height that is greater than the height of the cap.

26. A battery powered light, comprising:

a light element for providing a source of light;

a housing for housing the light, wherein the housing comprises a battery compartment configured to receive a plurality of batteries a plurality of generally cylindrical batteries in the battery compartment and in circuit with the light element, wherein each battery has a longitudinal axis and the batteries are adjacent one another so that the longitudinal axes are offset from one another;

a cover for closing an opening to the battery compartment, wherein the cover comprises a releasable connection with the housing and wherein twisting the cover relative to the housing connects or disconnects the cover with housing;

a contact plate comprising a plurality of contacts for providing electrical contact with contacts of the batteries;

a first alignment element comprising an elongated rod extending parallel to the batteries;

a second alignment element configured to cooperate with the first alignment element;

wherein the first alignment element is connected with one of the housing and the cover and the second alignment element is connected with the other of the housing and the cover and the first and second alignment elements guide the contacts into electrical contact with contacts of the batteries when the contact plate is displaced toward the battery compartment;

wherein the contact plate is displaceable relative to the cover when the cover is rotated to connect or disconnect the cover with the housing.

27. The light of claim 26 wherein the first alignment element is axially elongated so that the first alignment element can be inserted into the second alignment element when the cap is spaced from the housing.

28. The light of claim 5 wherein the first alignment element has a non-circular cross-section.

* * * * *